United States Patent [19]

Robinson

[11] Patent Number: 4,715,629

[45] Date of Patent: Dec. 29, 1987

[54] CHILD PROOF CLOSURE DEVICE FOR DOORS

[76] Inventor: Alan J. Robinson, 202 Westminster St., Christchurch, New Zealand

[21] Appl. No.: 808,116

[22] Filed: Dec. 12, 1985

[30] Foreign Application Priority Data

Oct. 30, 1985 [NZ] New Zealand ..... 209380

[51] Int. Cl.[4] ..... E05B 65/06

[52] U.S. Cl. ..... 292/256; 292/258; 292/288

[58] Field of Search ..... 292/246, 247, 249, 258, 292/288, 264, 114, 256, 67, 69, DIG. 16, 209; 24/30.5 P; 254/199

[56] References Cited

U.S. PATENT DOCUMENTS

| | | | |
|---|---|---|---|
| 257,986 | 5/1882 | Skerrett | 292/264 |
| 949,619 | 2/1910 | Burch | 292/258 |
| 2,608,711 | 9/1952 | Moore | 292/288 |
| 2,687,318 | 8/1954 | Cooper | 292/114 |
| 3,287,045 | 11/1966 | Avery | 292/114 |
| 3,893,725 | 7/1975 | Coulter et al. | 292/258 |
| 4,290,633 | 9/1981 | Sullivan | 292/DIG. 38 X |

FOREIGN PATENT DOCUMENTS 1045847 12/1958 Fed. Rep. of Germany ..... 292/256

*Primary Examiner*—Lloyd A. Gall

*Attorney, Agent, or Firm*—Holman & Stern

[57] ABSTRACT

A child proof lock which has two parts. The first part is of strap-like construction, is attachable to a surface at one end, has a shaped aperture at the other, and has an elastic portion between the two ends. The second part is also attachable to a surface and includes a rotatably mounted toggle. The toggle is shaped so as to be able to pass through the aperture in the first part only when it has been correctly rotationally oriented. In use the first and second part of the child proof lock are attached to opposite sides of a door opening in a relationship whereby the first part must be expanded to allow the toggle to pass through the aperture. To lock the device the toggle on the second part is correctly rotationally oriented, the first part is expanded and the aperture passed over the toggle. When the first part retracts an abutment on the first part rotates the toggle thus locking the device. To unlock the device the first part is expanded using one hand and the toggle is rotated using the other hand enabling the two parts to be disengaged.

15 Claims, 7 Drawing Figures

CHILD PROOF CLOSURE DEVICE FOR DOORS

FIELD OF THE INVENTION

This invention relates to a child proof closure device for doors.

DESCRIPTION OF THE PRIOR ART

It is well-known that young children love exploring their environments opening cupboards, drawers, refrigerator doors and the like and generally "getting into things". The obvious solution to this problem is to provide a locking device with the door to prevent the child from opening it. However, many doors that a parent would want to lock are not fitted with a suitable device. The existing childproof locks that may be fitted to a door are expensive and can only be fitted to certain types of doors. For example very few could be fitted to a refrigerator, chest freezer or chest of drawers.

SUMMARY OF THE INVENTION

It is an object of the invention to provide a child proof locking device which goes some way towards overcoming the above mentioned disadvantages.

It is a further object of the invention to provide a child proof locking device including an elastic elongate first part with a first lock portion and a second part with a second lock portion engageable with the first lock portion. The construction and arrangement of the first and second parts of the locking device being such that in use the first and second parts can be attached to opposite sides of a door opening or the like in a relationship whereby the first part of the locking device must be expanded to allow the first and second lock portions to engage/disengage.

It is a further object of the invention to provide a child proof locking system in which a first part of a lock must be expanded with one hand to position a first lock portion in relation to a second lock portion on a second part of the lock, to enable manipulation of one or other of the lock portions with the other hand to lock or unlock the system.

It is a further object of the invention to provide a method of child proof locking a door comprising the steps of: (a) Fixing a first part of a child proof lock to a door lid or the like. (b) Fixing a second part of a child proof lock to a door surround or a second door. The relative positioning and construction of the first and second parts such is that the lock can only be locked or unlocked while the length of the elongate part is changed by expansion thereof.

DESCRIPTION OF THE PREFERRED EMBODIMENTS

Figure 1:
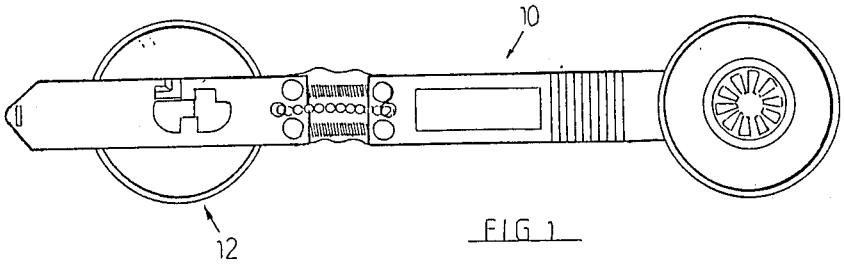
FIG. 1 shows a plan view of a locking device in its locked configuration.
Figure 2:
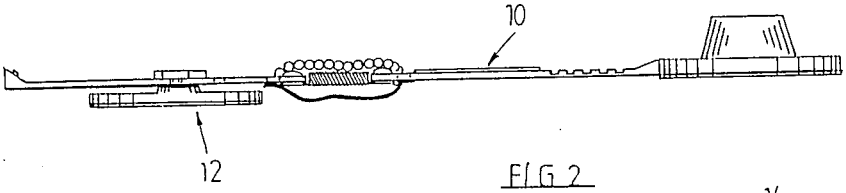
FIG. 2 shows a side elevation of the locking device shown in FIG. 1.
Figure 3:
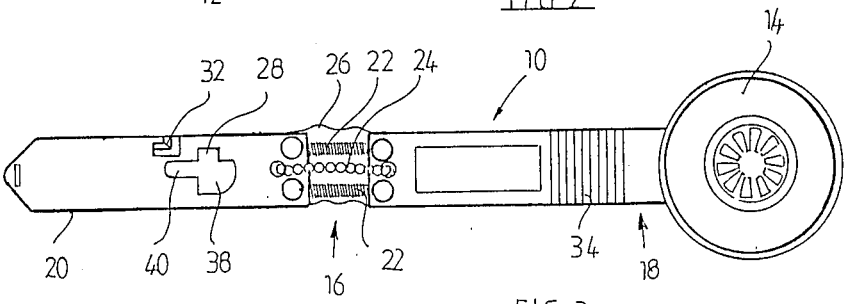
FIG. 3 shows a plan view of an elongate first part of the locking device of FIG. 1.
Figure 4:
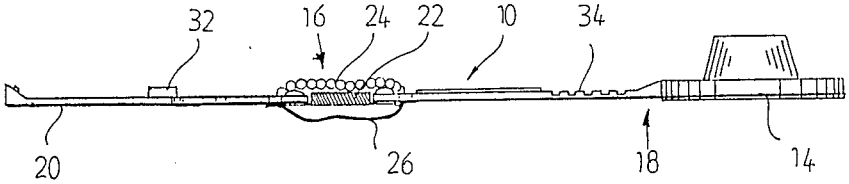
FIG. 4 shows a side elevation of the first part shown in FIG. 3.

The preferred embodiment of the invention will be described with reference to its use to child proof a cabinet, for example, a refrigerator, medicine cabinet or the like. It is to be appreciated that the invention can also be used to close a pair of doors, the lid of a chest such as a chest freezer, or a drawer of the like.

The closure device has a first part 10 and a second part 12. The first part 10 is generally elongate and has an adhesive pad 14 at one end, to fasten it to a door or door surround. The first part 10 is of strap-like construction and manufactured from plastics or the like flexible but non-elastic material. A central elastic or spring loaded portion 16 divides the first part into two ends, a fixed end 18 and a tongue 20, and is formed by two expansion springs 22 substantially parallel to the longitudinal direction of the first part 10. To prevent overexpansion of the springs 22 a chain 24 is fixed in parallel with the springs 22. To prevent the coils of the springs 22 from gripping or catching on material thereunder a strip of normally slack flexible material 26 is attached between the ends of the first part so as to lie under the springs in use.

The tongue 20 has a keyway 28 provided therein, the shape of which is such that in use it mates with a complementary key 30 in the second part 12. An abutment 32 is formed into the tongue 20 adjacent keyway 28.

Figure 7:
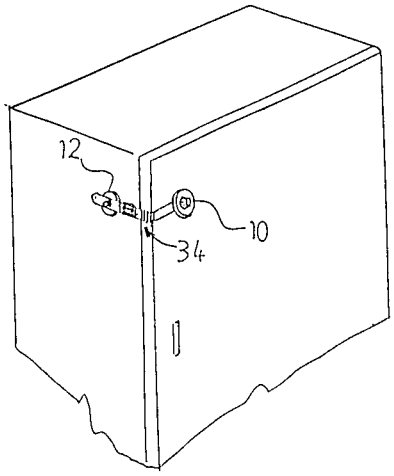
FIG. 7 shows a perspective view of the locking device installed on a cabinet door.

To aid the placement of the present invention around a corner of a cabinet to lock a door or lid there is provided a corrugated region 34 to facilitate the flexing of the part 10 as shown in FIG. 7.

The second part 12 has a base 36 with an adhesive pad to fasten the second part 12 to a door or door surround. Other methods of fixing such as screws could be used. The second part 12 has a key or toggle 30 which is rotatably mounted on the base 36 of the second part 12. The second part 12 is manufactured from a plastics material, for example, in an injection moulding machine.

Figure 5:
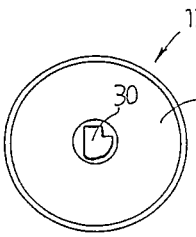
FIG. 5 shows a plan view of a second part shown in FIG. 1 usable with the first part shown in FIG. 3.
Figure 6:
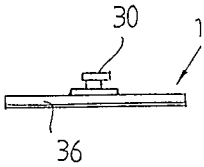
FIG. 6 shows a side elevation of the second part shown in FIG. 5.

In use the first part 10 and second part 12 are fixed, for example, as shown in FIG. 7. The parts are positioned so that in order to engage the key 30 of second part 12 with the keyway 28 the elastic portion 16 must be stretched. The key 30 is initially in the position shown in FIG. 5. In this position the first part 10 is stretched to allow the key 30 to be aligned with section 38 of the keyway 28 which is of the same shape as the key 30. The key 30 is slotted through section 38 and the first part 10 released thereby the elastic portion 16 is allowed to retract. This retraction causes the abutment 32 to turn the key 30 through approximately 90 degrees. The key 30 then slides to the end 40 of the keyway 28 as shown in FIG. 1.

To disengage the parts 10 and 12 it is necessary to use two hands in a co-ordinated manner not possible for small children. The tongue 20 is gripped to stretch the springs 22 until the key 30 is free from the abutment 32. The key 30 must then be rotated to allow the key 30 to pass through the section 38 of keyway 28. The parts are then freed by lifting the tongue 20.

The operation of the invention relies in the fact that the first part must be expanded to allow the locking portions to engage/disengage.

Therefore it will be appreciated that the invention can be varied in numerous ways, for example:

The male portion of the lock may be disposed on the second part, while the female portion may be disposed on the first part.

The lock may consist of a latch, or a rotatable key or peg to engage with a recess in the second part through an aperture in the first part.

The elasticity of the first part may be provided by a rubber strip or other suitable means.

An advantage of the invention is that it is inexpensive, safe and requires a degree of manual dexterity to release, beyond that of young children.

Thus by this invention there is provided a child proof safety of locking device usable for locking a door or doors.

A particular example has been described herein by way of example and it is envisaged that improvements and modifications can take place without departing from the scope thereof.

What is claimed is:

1. A child proof locking system having a first part with a first lock means, a second part with a second lock means, means for expanding the first part with one hand to engage the first lock means with the second lock means, and interengaging means on the first and second parts for moving one of the lock means to a locking position upon release of the first part by the one hand, whereby only the one hand is required to lock the system, and from which locking position a first hand is required to expand the first part and a second hand is required to manipulate said one of the lock means to unlock the system.

2. A child proof locking device including:

an elongated first part having attaching means located towards one end and first lock means located towards the other end, said first part provided with elasticity within predetermined limits in the longitudinal direction such that the length of said first part can be varied by expansion thereof from a normal position, a second part having attaching means and a second lock means engageable/or disengageable with said first lock means and lockable thereto by manipulating one of said lock means from an unlocking position to a locking position, the construction and arrangement of said first and second parts being such that in use said first and second parts can be attached to opposite sides of a door opening in a relationship whereby the first must be expanded to allow said first and second lock means to engage or disengage, the device including interengaging means on the first and second parts for moving said one of the lock means from the unlocking position to the locking position upon engagement of the lock means, by release of the first part towards the normal position.

3. A child proof locking device as claimed in claim 1 in which the first part is elastic to allow said first and second lock means to engage or disengage.

4. A child proof locking device as claimed in claim 1 wherein the first part is made of plastics material and the flexibility of said first part is increased by providing said first part with a corrugated region.

5. A child proof locking device as claimed in claim 1 wherein said attaching means are planar portions covered with a contact adhesive.

6. A child proof locking device as claimed in claim 1 wherein: the elasticity of said first part is provided by a heterogeneous elastic section provided between the surface attaching means and the first lock means.

7. A child proof locking device as claimed in claim 6 in which said first part is expansively elastic such that the length of said first part can be varied by expansion thereof.

8. A child proof locking device as claimed in claim 6 wherein:

said first lock means is a female engaging recess and said second lock means is a manipulable male engaging means.

9. A child proof locking device as claimed in claim 8 wherein:

the male engaging means includes a key which is rotatably mounted on said second part, and the female engaging recess is a keyway in said first part shaped to allow the key to pass therethrough when the key has the correct rotational orientation and the elastic section has been suitably deformed.

10. A child proof locking device as claimed in claim 9 wherein:

the keyway in said first part is of an L shape with a quarter circle sector superimposed over the apex thereof and the radii bounding the sector are a continuation of the line segments joining at the inner apex of the L; and the key has the shape of a quarter circle sector with a rectangle abutting one of the bounding radii of the sector such that a longer side of the rectangle is superimposed along a portion of said one of the bounding radii with a corner of the rectangle touching the apex of the sector and such that the key when suitably oriented can pass through that portion of the keyway comprising the sector and the shorter of the arms of the L shape.

11. A child proof locking device as claimed in claim 10 wherein:

an abutment is provided on said first part adjacent to the longer arm of the L which causes the key to rotate as said first part returns to its unextended position after the key has been placed through said female engaging recess.

12. A child proof locking device as claimed in claim 6 wherein:

said first lock means is a manipulable male engaging means and said second lock means is a female engaging recess.

13. A child proof locking device as claimed in claim 12 wherein:

said heterogeneous elastic section is comprised of one or more expansion springs, which are substantially parallel to the longitudinal direction of the first part.

14. A child proof locking device as claimed in claim 13 wherein:

expansion limiting means are provided with said springs to prevent the over expansion thereof.

15. A child proof locking device as claimed in claim 13 wherein a strip of flexible material is connected to said first part under said springs to prevent the springs gripping or catching on material thereunder.

* * * * *